United States Patent [19]

Nilssen

[11] Patent Number: 4,496,878

[45] Date of Patent: Jan. 29, 1985

[54] SCREW-IN FLUORESCENT LAMP

[76] Inventor: Ole K. Nilssen, Caesar Dr., Rte. 5, Barrington, Ill. 60010

[21] Appl. No.: 367,911

[22] Filed: Apr. 13, 1982

[51] Int. Cl.[3] ..... H01J 7/44; H01J 17/34; H01J 19/78; H01J 29/96

[52] U.S. Cl. ..... 315/73; 313/493; 362/216; 315/56; 315/58; 315/DIG. 5

[58] Field of Search ..... 315/56–58, 315/62, 73, 100, DIG. 5, 50, 51; 313/493; 362/216

[56] References Cited

U.S. PATENT DOCUMENTS

| | | | |
|---|---|---|---|
| 4,178,535 | 12/1979 | Miller | 315/100 X |
| 4,318,160 | 3/1982 | Dooley et al. | 362/216 |
| 4,334,179 | 6/1982 | Wyner et al. | 315/57 X |

*Primary Examiner*—Saxfield Chatmon

[57] ABSTRACT

In the preferred version of the invention, the lamp-starter combination is mounted on a three-terminal screw-base of the type used with regular three-way incandescent lamps; and the two terminals required for operating the lamp-starter combination are connected with the outer threaded terminal and the middle (or the third) terminal of the base—leaving the center terminal non-connected. By using this version of a screw-base-mounted fluorescent lamp in a lamp socket of the type used with three-way incandescent lamps—but without having a switch in the socket—and by connecting the power line voltage to the third socket electrode by way of the current-limiting inductor means, this lamp will properly operate therein. Yet, if by mistake this lamp is inserted into a regular one-way incandescent-type lamp socket furnished with a non-current-limited power line voltage, the lamp will not be destroyed. Moreover, by connecting the non-current-limited power line voltage to the center electrode of this socket, regular one-way incandescent lamps may be properly used therein, thereby providing for a lamp socket that is adapted to properly using either a regular incandescent lamp or, alternately and interchangeably, a non-self-ballasted fluorescent lamp.

4 Claims, 2 Drawing Figures

1
2
2A
2Ab
2B
2Aa
2Ba
2Bb
3
4
4a
4c
5
6
7
9
10
13a
12a
12
8
13b
12b
13
11

14
2'
2'A
2'Ab
2'B
2'Ba
2'Aa
2'Bb
3'
15
15o
15c
15m
16
16m
16c
17
16o
19
18
17b
17a

SCREW-IN FLUORESCENT LAMP

BACKGROUND OF THE INVENTION

1. Field of the Invention

The present invention relates to fluorescent lamps, particularly of a kind that is not self-ballasted, yet mounted on an Edison-type screw-base and intended for use in ordinary screw-in lamp sockets.

2. Cross-reference to Related Application

The present patent application is related to another patent application of mine entitled "Incandescent-Fluorescent Compatible Lighting Products"—an application being filed concurrently with the present application, now U.S. Pat. No. 4,450,510.

3. Description of Prior Art

Self-ballasted fluorescent lamps of a type that is capable of being used in ordinary portable and fixtured lighting products with regular Edison-type screw-in lamp sockets presently do exist, and can in fact be purchased from Westinghouse Electric Corporation, Bloomfield, N.J., or from North American Philips Lighting Corporation, Tarrytown, N.Y.

However, to the best of my knowledge, there presently exist no non-self-ballasted fluorescent lamps of a type that can be screwed into and properly used in regular Edison-type screw-in lamp sockets; nor have such lamps ever been described in literature known to me.

SUMMARY OF THE INVENTION

Objects of the Invention

One object of the present invention is that of providing a basis for making compact and light-weight fluorescent lamps mounted on Edison-type screw-bases and adapted for use with regular incandescent-type screw-in lamp sockets.

A further object is that of providing a basis for making lighting products with regular incandescent-type screw-in lamp sockets capable of receiving, holding, and powering non-self-ballasted screw-in fluorescent lamps.

These as well as other objects, features and advantages of the present invention will become apparent from the following description and claims.

Brief Description

The present invention relates to the concept of providing non-self-ballasted—and therefore compact, light-weight, and economical—fluorescent lamps mounted on ordinary Edison-type screw-bases. With such lamps available, it becomes possible to provide various kinds of lighting products with regular Edison-type screw-in lamp sockets and which are capable of being used with these non-self-ballasted screw-in fluorescent lamps. In fact, with the help of simple switch means, it even becomes cost-effectively feasible to provide lighting products that may be used not only with such screw-in fluorescent lamps, but—alternately and interchangeably—with ordinary Edison-type incandescent lamps.

In one embodiment, a U-shaped pre-heat flurescent lamp and a matching lamp starter are inter-coupled and mounted on a regular one-way (two-terminal) Edison-type screw-base. The resulting screw-in fluorescent lamp is then used in an ordinary plug-in incandescent-type table lamp, but only after a suitable current-limiting inductor means has been interposed between the lamp's plug and the receptacle into which the plug would normally have been inserted.

Of course, if this particular screw-in fluorescent lamp were to be inadvertently inserted into a regular one-way incandescent-type lamp socket supplied with non-current-limited power line voltage, lamp destruction would occur.

In the preferred embodiment, a U-shaped pre-heat fluorescent lamp and a matching lamp starter are inter-coupled and mounted on a regular three-way (three-terminal) Edison-type screw-base. The lamp-starter combination is connected between the outer (threaded) base electrode and the middle (or third) base electrode on the three-way base; with the center electrode being left non-connected. Thus, if this particular screw-in fluorescent lamp is inserted into a regular one-way incandescent lamp socket supplied witn non-current-limited power line voltage, lamp destruction can not occur, since no connection is made with the third base electrode.

This screw-in fluorescent lamp is then used in a three-way lamp socket where the threaded portion of the socket (the outer socket electrode) is connected directly to the one side of the power line; the center socket electrode is directly connected to the other side of the power line; and the middle socket electrode is connected indirectly, by way of a current-limiting inductor means, to the other side of the power line.

DESCRIPTION OF THE PREFERRED EMBODIMENT

Figure 1:
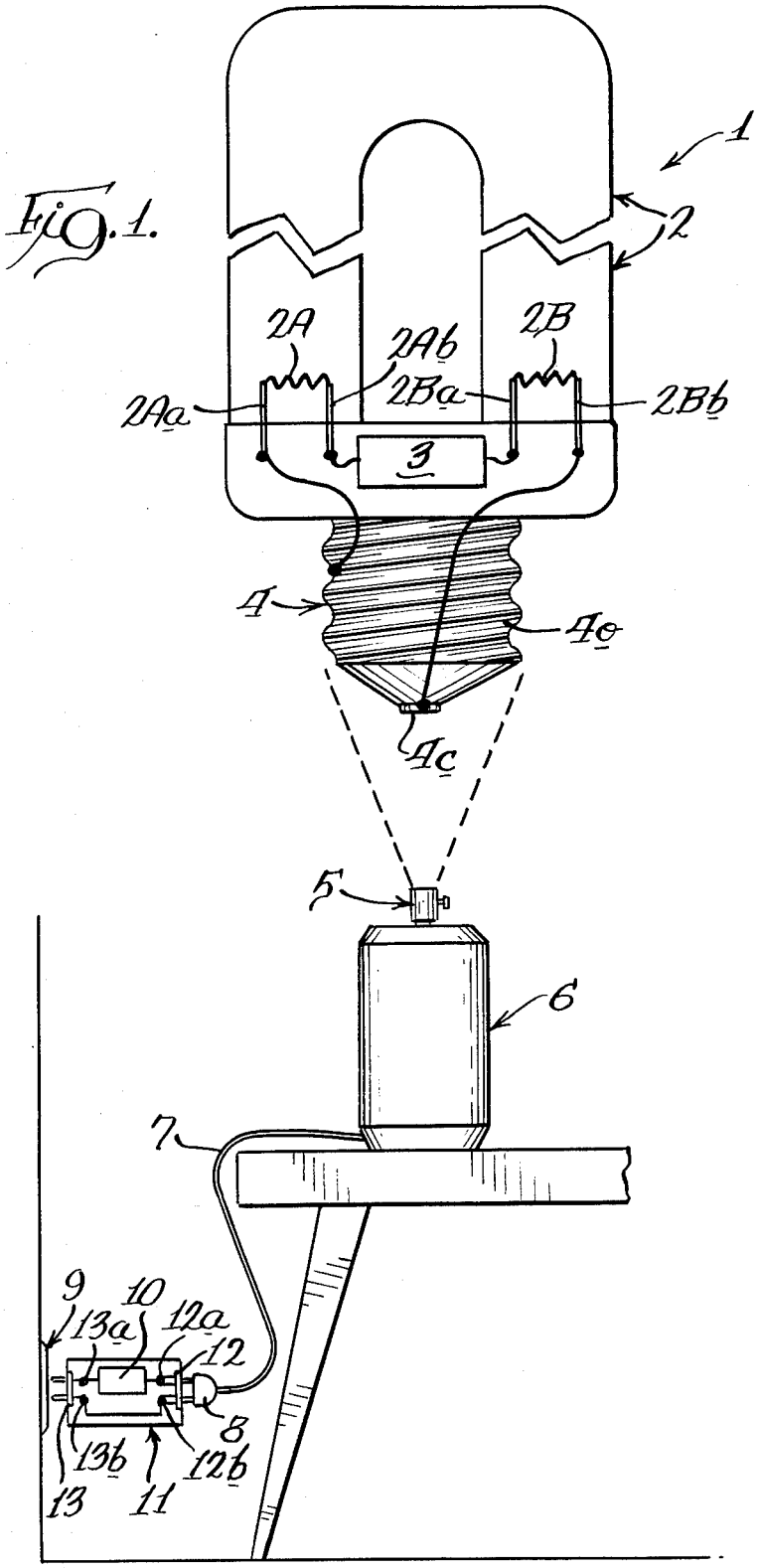
FIG. 1 illustrates a simple initial embodiment of the present invention, showing the fluorescent lamp-starter assembly as mounted on a regular one-way Edison-type screw-base and as applied in an anticipated usage situation.

An initial version of the present invention is illustrated by FIG. 1. Shown there is a complete screw-in fluorescent lamp assembly 1 consisting of a U-shaped fluorescent lamp 2 and a fluorescent lamp starter 3, both of which are mounted on an ordinary two-terminal one-way Edison-type screw-base 4. The fluorescent lamp has two cathodes 2A and 2B, with cathode 2A having two input terminals 2A*a* and 2A*b*, and cathode 2B likewise having input terminals 2B*a* and 2B*b*. Screw-base 4 has two contact electrodes: an outer electrode 4*o* and a center electrode 4*c*. Connected between cathode terminals 2A*b* and 2B*a* is an ordinary fluorescent lamp starter 3. Cathode terminal 2A*a* is connected with base outer electrode 4*o*, and terminal 2B*b* is connected with base center electrode 4*c*.

Screw-in fluorescent lamp 1 is intended for insertion into lamp socket 5 of a regular table lamp 6, which table lamp has a power cord 7 with a plug 8 suitable for insertion into a regular household power receptacle 9. An inductor means 10 is mounted in a housing 11, which housing has receptacle means 12 adapted to receiving any ordinary household power plug, such as plug 8. Housing 11 also has plug means 13 adapted for connection with any ordinary household power receptacle, such as receptacle 9.

Receptacle means 12 has two terminals 12*a* and 12*b;* plug means 13 has two terminals 13*a* and 13*b*. Terminals 12*b* and 13*b* are directly connected together; terminals 12*a* and 13*a* are connected together through inductor means 10.

The operation of the arrangement of FIG. 1 may be understood simply by observing that when the screw-in fluorescent lamp 1 is placed into lamp socket 5—with lamp plug 7 inserted into receptacle 12 and with plug means 13 inserted into power receptacle 9—fluorescent lamp 2 with its starter 3 is connected with the power line through a current-limiting inductor means, and will therefore start and operate in the manner of any regular pre-heat fluorescent lamp as normally used.

Figure 2:
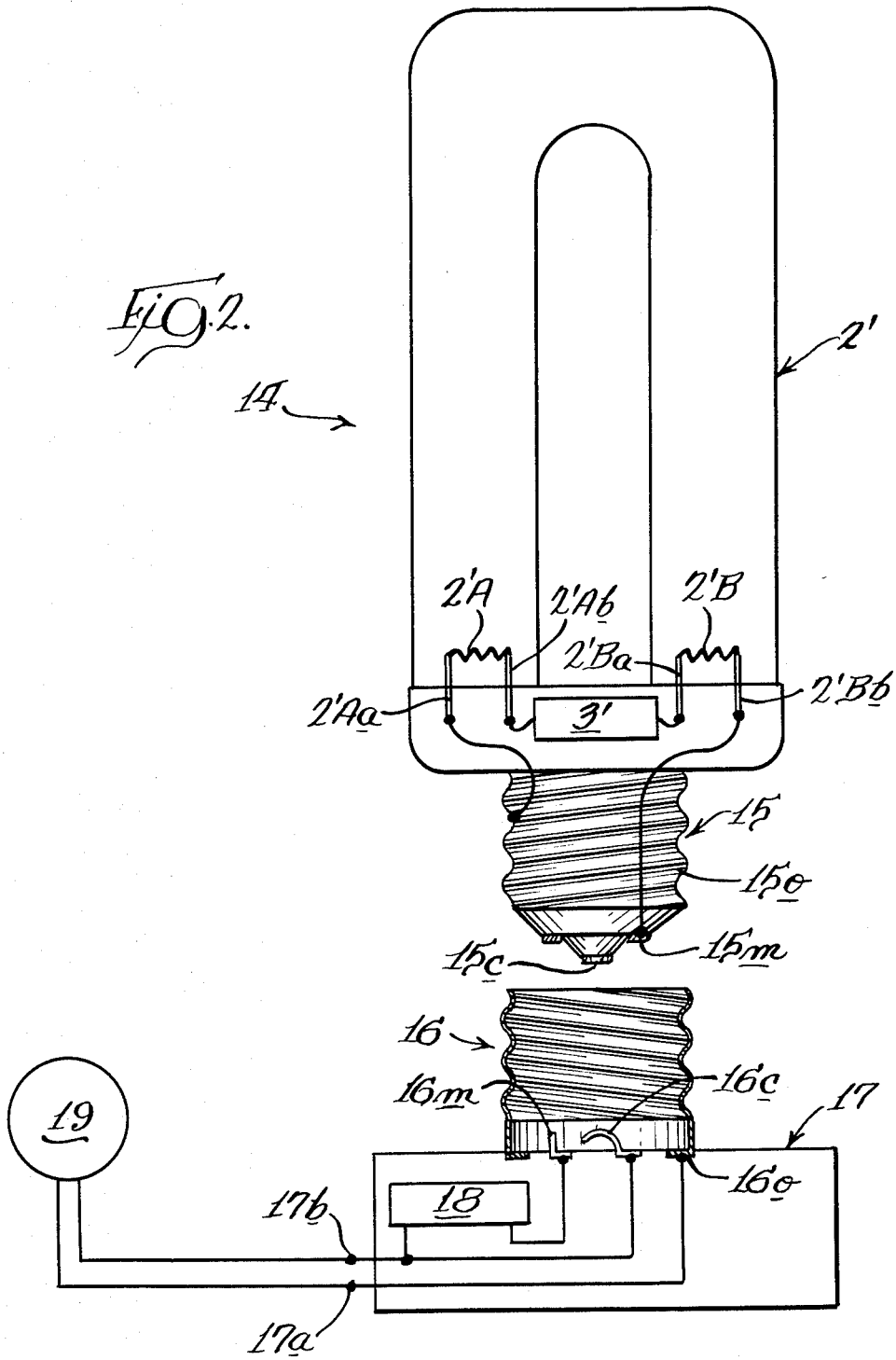
FIG. 2 illustrates the preferred embodiment of the present invention, showing details of the lamp-starter combination as mounted on a three-way Edison-type screw-base, as well as of a matching screw-in lamp socket with its connections to the current-limiting inductor means and the power line.

The preferred embodiment of the present invention is illustrated in FIG. 2, where is shown a complete fluorescent lamp assembly 14 consisting of a U-shaped fluorescent lamp 2' and a fluorescent lamp starter 3' (which lamp and starter are identical to the lamp and starter of FIG. 1), both of which are mounted on a screw-base 15 of the type used with ordinary incandescent three-way lamps. The fluorescent lamp has two cathodes 2'A and 2'B—with cathode 2'A having two input terminals 2'A*a* and 2'A*b*, and cathode 2'B having two input terminals 2'B*a* and 2'B*b*. Screw-base 15 has three contact electrodes: an outer base electrode 15*o*, a middle base electrode 15*m*, and a center base electrode 15*c*. Connected between cathode terminals 2'A*b* and 2'B*a* is the fluorescent lamp starter 3'. Cathode terminal 2'A*a* is connected with outer base electrode 15*o*, and terminal 2'B*b* is connected with middle base electrode 15*m*. The center base electrode 15*c* is left non-connected.

Screw-in fluorescent lamp assembly 14 is intended for insertion into three-way lamp socket 16, which lamp socket has three lamp-contacting electrodes 16*o*, 16*m*, and 16*c* adapted to make contact with lamp base electrodes 15*o*, 15*m*, and 15*c*, respectively, whenever lamp assembly 14 is inserted into lamp socket 16. The lamp socket is mounted on a housing 17, which housing comprises a current-limiting inductor means 18. By way of input terminals 17*a* and 17*b*, housing 17 is provided with an AC voltage input from a source 19, which source may be a regular electric utility power line.

Socket electrode 16*o* is connected directly with input terminal 17*a;* socket electrode 16*c* is connected directly with input terminal 17*b;* while socket electrode 16*m* is connected with input terminal 17*b* by way of inductor means 18.

The operation of the preferred embodiment of FIG. 2 may be understood by observing that whenever the screw-in lamp assembly 14 is inserted into lamp socket 16, the fluorescent lamp 2' with its starter 3' gets connected to the power line by way of the current-limiting inductor means 18; and the fluorescent lamp will thus start and operate in its usual manner. Yet, if lamp assembly 14 is inserted into a regular one-way lamp socket—which socket does not have a middle electrode—no contact can be established between the lamp and the power line, even if this one-way lamp socket has the power line voltage present between its two electrodes.

It should also be noted that, if inserted into three-way socket 16, an ordinary one-way Edison-type incandescent lamp will be properly powered directly from the power line—just as it would be in any regular one-way lamp socket.

Thus, when arranged as shown in FIG. 2, a substantially regular three-way lamp socket can receive, hold, and properly operate a screw-in fluorescent lamp or, alternately and interchangeably, an ordinary one-way incandescent lamp.

I believe that the present invention and its several attendant advantages and features will be understood from the preceeding description. However, without departing from the spirit of the invention, changes may be made in its form and in the construction of its constituent parts; the form herein presented merely representing its preferred embodiment.

I claim:

1. A fluorescent lamp assembly adapted to be powered from a current-limited voltage source and to be used in screw-in-type sockets of the kind normally used with three-way incandescent lamps said assembly comprising:

a fluorescent lamp having a first and a second cathode, each cathode having a first and a second input terminal, a fluorescent lamp starter connected between the second input terminal of said first cathode and the first input terminal of said second cathode, and a three-way screw-base adapted to be screwed into and used in said screw-in-type sockets, said screw-base having a first, a second and a third base terminal, said first base terminal being directly connected with the first input terminal of said first cathode, said second base terminal being directly connected with the second input terminal of said second cathode, said third base terminal being left non-connected.

2. A fluorescent lamp assembly adapted to be screwed into, held by, and operated in lamp sockets of the type normally used for three-way incandescent lamps, said assembly comprising:

a fluorescent lamp having a first and a second cathode, each cathode having a first and a second input terminal, a fluorescent lamp starter connected between the second input terminal of said first cathode and the first input terminal of said second cathode, and a three-way screw-base adapted to be screwed into, held by, and used in said type of lamp sockets, said screw-base having a first, a second and a third base terminal, said first base terminal being directly connected with the first input terminal of said first cathode, said second base terminal being directly connected with the second input terminal of said second cathode, and said third base terminal being left non-connected.

3. The fluorescent lamp assembly of claim 2 wherein the threaded portion of said three-way screw-base constitutes said first base terminal, and wherein the ring-shaped middle electrode on the three-way screw-base constitutes said second base terminal.

4. A fluorescent lamp (2') mounted on a screw-base (15) of the type normally used for three-way incandescent lamps, said lamp having a first lamp electrode (2'A*a*) and a second lamp electrode (2'B*b*), said screw-base having an outer electrode (15*o*), a middle electrode (15*m*), and a center electrode (15*c*), said first lamp electrode being directly connected with said outer electrode, said second lamp electrode being directly connected with said middle electrode, said center electrode being left non-connected.

* * * * *